United States Patent [19]

Ikeda et al.

[11] Patent Number: 4,730,947

[45] Date of Patent: Mar. 15, 1988

[54] PRINTER HAVING A CONTROL CIRCUIT SECTION OF CASSETTE TYPE

[75] Inventors: Hiroshi Ikeda, Tokorozawa; Kimihiro Kosugi, Tanashi; Kazumi Hasegawa, Tokyo, all of Japan

[73] Assignee: Citizen Watch Co., Ltd., Tokyo, Japan

[21] Appl. No.: 894,882

[22] Filed: Aug. 8, 1986

[30] Foreign Application Priority Data

Aug. 19, 1985 [JP] Japan ..... 60/125725[U]
Sep. 10, 1985 [JP] Japan ..... 60/137555[U]

[51] Int. Cl.[4] ..... B41J 5/30; B41J 29/02

[52] U.S. Cl. ..... 400/61; 400/76; 400/692

[58] Field of Search ..... 400/61, 62, 63, 66, 400/70, 71, 76, 77, 78, 79, 80, 81, 691, 692, 693; 365/63

[56] References Cited

U.S. PATENT DOCUMENTS

| | | | |
|---|---|---|---|
| 2,924,321 | 2/1960 | Ziskind et al. | 400/70 X |
| 3,557,927 | 1/1971 | Wright et al. | 400/77 X |
| 4,388,010 | 6/1983 | Mott et al. | 400/692 |
| 4,660,999 | 4/1987 | Tsuneki | 400/692 X |
| 4,671,683 | 6/1987 | Ueno et al. | 400/76 X |

FOREIGN PATENT DOCUMENTS

| | | | |
|---|---|---|---|
| 0035004 | 9/1981 | European Pat. Off. | 400/692 |
| 0110632 | 6/1984 | European Pat. Off. | 400/61 |
| 232978 | 11/1985 | Japan | 400/70 |

*Primary Examiner*—Charles A. Pearson
*Attorney, Agent, or Firm*—Lowe, Price, Leblanc, Becker & Shur

[57] ABSTRACT

A printer having a control circuit device adapted to be connected to a host computer through a cord for drivingly controlling operating sections which includes a printing mechanism and a sheet feeding mechanism.

A control part of the control circuit device is formed by a control circuit section in the form of cassette having an outer end portion to which one half portion of a connector is secured. This half portion of the connector is adapted to be connected with the other half portion of the same connector mounted on an associated end of the cord. In an internal space of the printer, a receiving section for accommodating therein the cassette type control circuit section is defined, so that the control circuit section is detachably mounted through an insert port which opens at a first side of the printer different from a second side thereof along which a printing sheet is fed to the printer.

9 Claims, 7 Drawing Figures

PRINTER HAVING A CONTROL CIRCUIT SECTION OF CASSETTE TYPE

BACKGROUND OF THE INVENTION

The present invention relates to a printer equipped with a control circuit section of cassette type which is detachably mounted in the printer.

Conventionally, a printer of a type having a control circuit which is adapted to be connected to an external controller such as a host computer, for control of various operating sections of the printer such as a printing mechanism and a printing sheet feeding mechanism, has been known. In the conventional printer of this kind, the control circuit of the printer is connected to the external controller by the use of flexible cord means having opposite ends each fixedly connected with one half portion of an associated connector, and the other half portion of one of the connectors at the side of the printer is securedly mounted on the rear wall of the printer, so as to connect the cord means with the printer at the rear side of the same printer. Further, in view of restrictions in design, the printer has been generally so constructed as to be fed with the printing sheet at the rear side of the printer. Accordingly, in the conventional printer, an annoying operation at the rear side of the printer remote from a user is required for connection and disconnection of the connector, and further, the cord and the thus fed sheet can interfere with each other, and therefore the sheet can be caught, broken or wrinkled, resulting in prevention of smooth supply of the sheet.

Furthermore, in the conventional printer, since the operating sections and the control circuit are disposed on substantially the same level in the direction of the printer, there occur various disadvantages. For instance, the printer becomes large in size, and complicated long wiring is required for connection between the control circuit and various component parts of the operating sections such as a printing head driving motor, a sheet feeding motor, various sensors, etc., to increase an amount of work in wiring.

SUMMARY OF THE INVENTION

It is an object of the present invention to provide a printer which is capable of effecting smooth sheet feed operation, and easily performing replacement and maintenance of a control circuit device determining an operation mode in which the printer is driven, which mode includes an interface condition with an external controller, and a type of pattern character to be printed, etc.

It is a further object of the present invention to provide a printer which is compact, and simple in wiring, and ensures reductions in number of component parts and an amount of work for assembly.

It is a still further object of the present invention to provide a printer having an improved external appearance.

According to the present invention, there is provided a printer having operating sections including a printing mechanism and a sheet feeding mechanism drivingly controlled by a control circuit device which is adapted to be connected to an external controller through cord means.

The printer comprises a cassette type control circuit section which forms a controlling part of the control circuit device, and is provided at its outer end portion with one half portion of a connector, which is adapted to be connected with the other half portion of the connector connected to an associated one end of the cord means. Arranged in an internal space of the printer is a receiving section for accommodating therein the cassette type control circuit section. The receiving section has an insert port which opens into one side of the printer different from a side thereof along which a printing sheet is fed to the sheet feeding mechanism of the printer. The cassette type control circuit section is detachably mounted in the receiving section of the printer through the insert port of the receiving section.

DETAILED DESCRIPTION

With reference to the accompanying drawings, an embodiment of the present invention will be explained.

Figure 1:
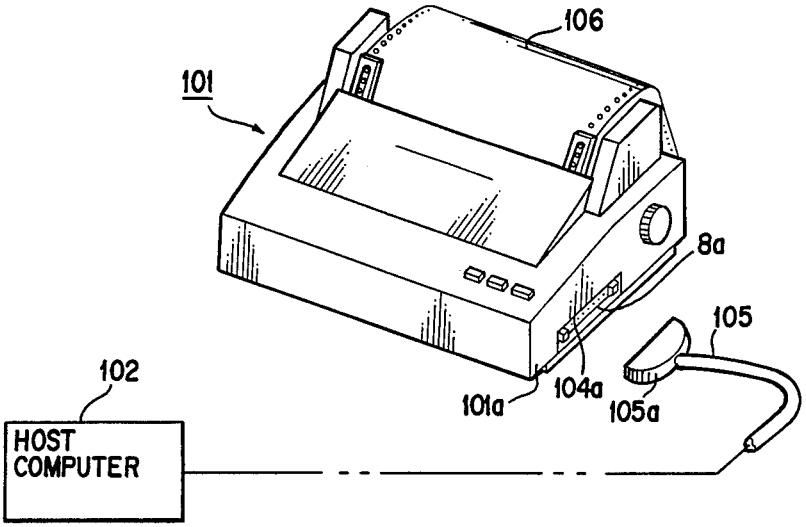
FIG. 1 is a schematic perspective view showing a printer according to an embodiment of the present invention.
Figure 2:
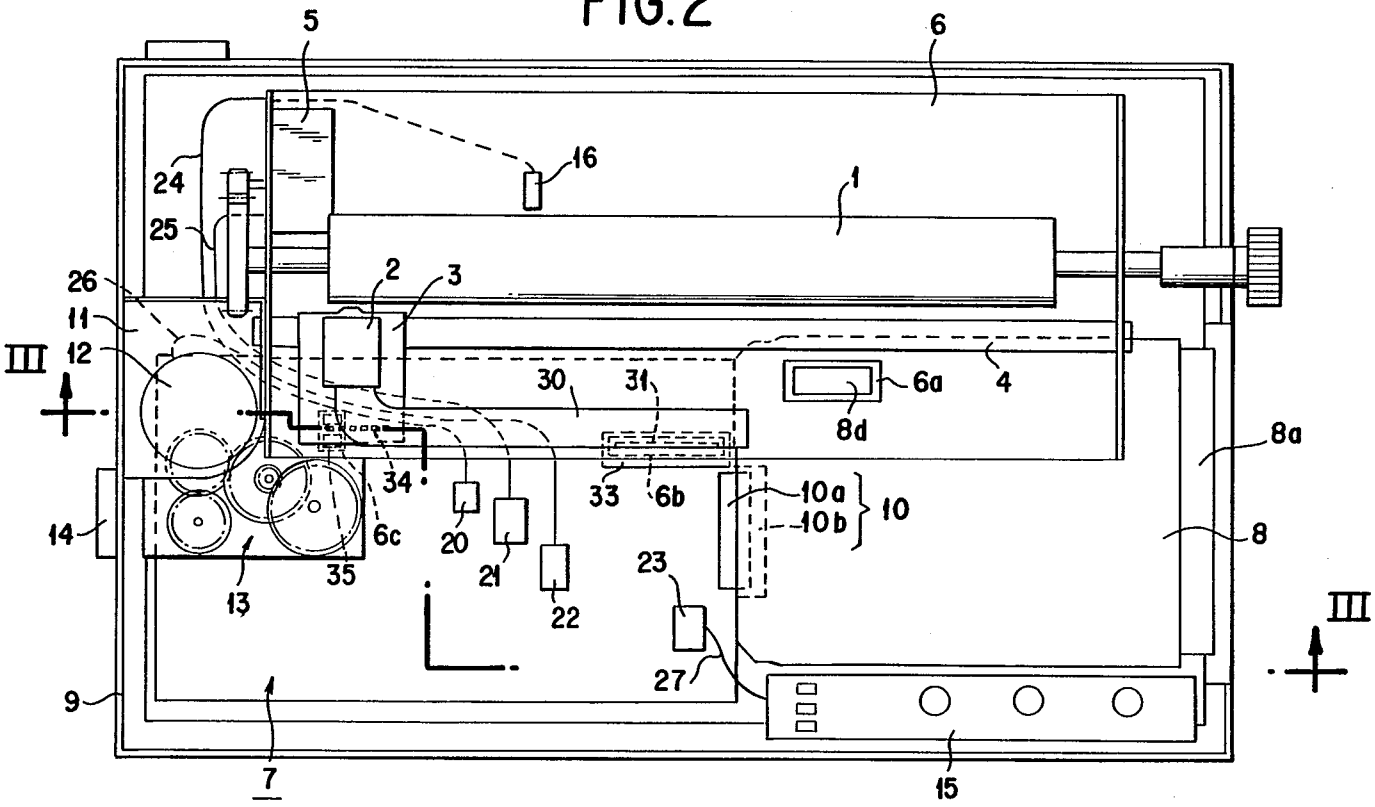
FIG. 2 is a schematic plan view of the interior of the printer of FIG. 1.
Figure 3:
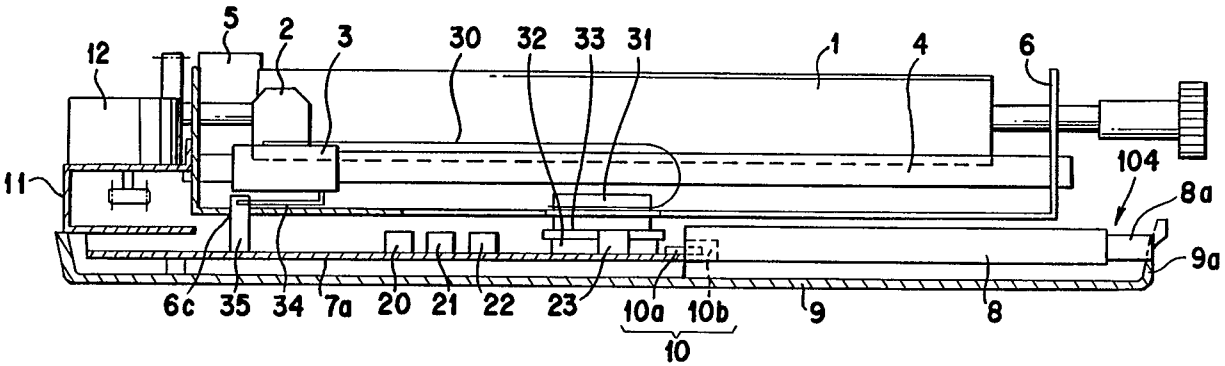
FIG. 3 is a front view, partially in cross-section, taken along line III—III of FIG. 2.

FIGS. 1 through 6 show a printer according to an embodiment of the present invention. In FIGS. 1 to 3, the printer 101 comprises operating sections (to be described later) and a control circuit device (to be described later) which is adapted to receive control signals from an external controller such as a host computer 102 for processing these signals, so that the operating sections are drivingly controlled to effect printing onto a printing sheet 106.

The operating sections mainly comprise a printing mechanism and a sheet feeding mechanism, more particularly, a platen 1 adapted to be rotatively driven by a sheet feed motor 5, and a printing head 2 supported by a carriage 3 which is in turn supported by a guide rod 4 and slidable therealong, these elements 1 to 5 being supported by a first frame 6 which extends horizontally of the printer 101 in an internal space of the printer. Fixed between the first frame 6 and a left side wall of a second frame 9 extending in parallel with the frame 6 is a motor support plate 11 on which a printing head driving motor 12 and a train of reduction gears 13 operatively coupled to an output shaft of the motor 12 are mounted, so that the printing head 2 supported by the carriage 3 is reciprocated by the motor 12 through the reduction gears 13 and a traction wire (not shown) connected to the carriage 3. Further, a power switch 14 and various switches 15 including a function key are mounted on a left side wall and a front wall of the second frame 9, respectively. A paper end switch 16 is fixed on the first frame 6 at its location behind the platen 1, this frame 6 being formed with an aperture 6c at a location opposite a position which is assumed by a detecting lever 34 secured to a lower face of the carriage 3 when the printing head 2 is in a home position. Furthermore, a home position sensor 35 is fixed to a printed circuit board 7*a* of an auxiliary circuit section 7 (to be described in detail later) of the control circuit device in alignment with the aperture 6*c*.

The control circuit device is disposed at a location below the first frame 6 within the internal space of the printer 101, and comprises a control circuit section 8 which is disposed in a receiving section 104 defined at a right half portion of the second frame 9, and the auxiliary circuit section 7 which is secured to a left half portion of the frame 9. The circuit sections 7 and 8 are disconnectably connected with each other through male and female half portions 10*a*, 10*b* of a connector 10, the respective connector portions being secured to opposite end faces of these sections, respectively.

Figure 4:
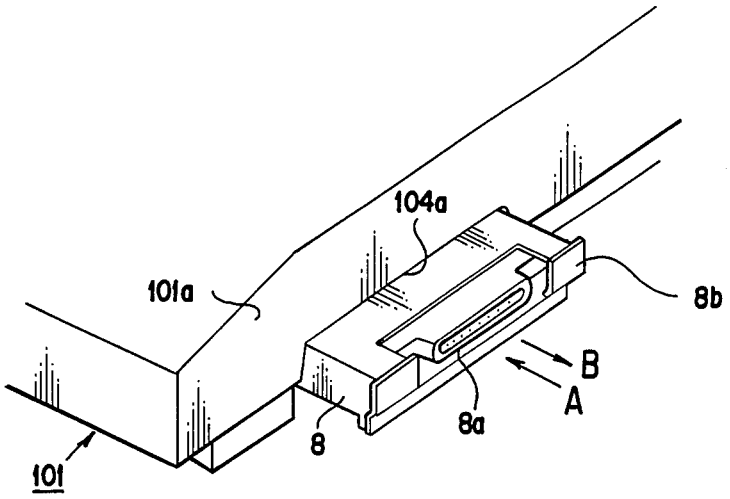
FIG. 4 is a fragmentary schematic perspective view showing an essential part of the printer of FIG. 1 wherein a cassette type control circuit section is pulled out from the printer.
Figure 5:
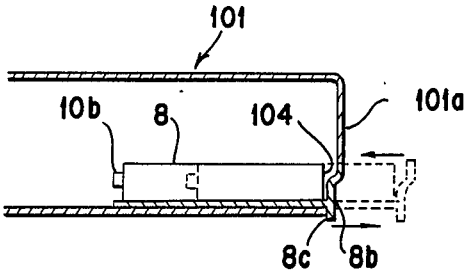
FIG. 5 is a fragmentary schematic longitudinal section view showing a manner of mounting and demounting the cassette type control circuit section.
Figure 7:
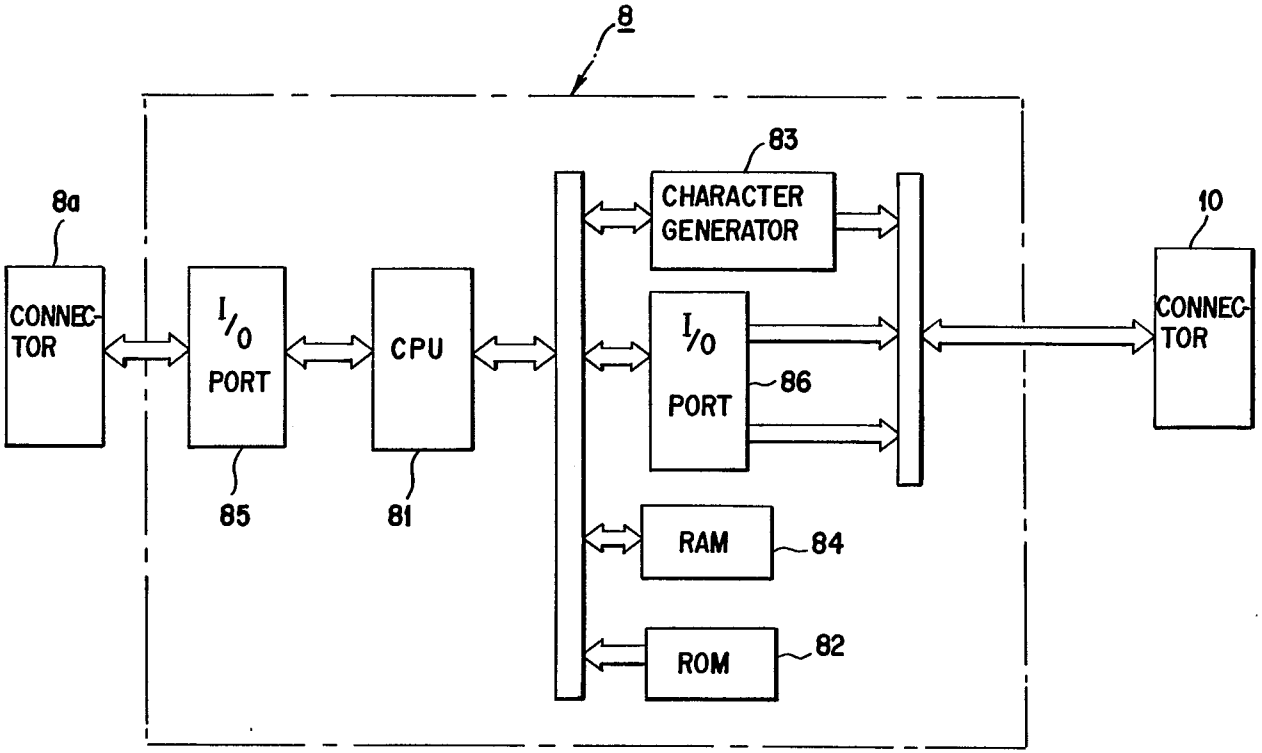
FIG. 7 is a schematic block circuit diagram of the cassette type control circuit section.

More specifically, the control circuit section 8 of the control circuit device is arranged to receive control signals from the host computer 102 for information processing to determine an interface condition with the computer and a type of character to be printed. This section 8 comprises, for instance, a central processor unit 81, ROMs 82, 83 for storing a control program and for generating character patterns, a buffer RAM 84, input/output ports 85, 86, as shown in FIG. 7. The circuit section 8 is constructed in the form of a cassette and so adapted that the whole arrangement thereof is integrally mounted in the receiving section 104 and integrally removed therefrom. Namely, as shown in FIG. 4, the receiving section 104 has an insert port 104*a* which opens into a side surface 101*a* of the printer 101, so that the cassette type control circuit section 8 is slidably inserted into and pulled out from the receiving section 104 through the insert port 104*a* thereof in the direction of the arrows A, B, with a rail-slot mechanism (not shown) formed in opposite faces of the sections 8, 104, for instance. Further, the control circuit section 8 has an outer end face 8*b* having a projection lower end 8*c* which is brought into urged contact with an outer side edge of a bottom wall of the printer 101 when the same section 8 is set in position in the receiving section 104, so that the outer end face 8*b* cooperates with the side face 101*a* of the printer 101 to form a continuous plane or exterior, as shown in FIG. 5. A dip switch 8*d* for setting various printing conditions is mounted on the cassette type control circuit section 8, and the first frame 6 is formed with an aperture 6*a* at a location corresponding to the dip switch 8*d*. The auxiliary circuit section 7 fixed to the second frame 9 has the above-mentioned printed circuit board 7*a* and connectors 20 to 23 mounted thereon, the connectors being connected to the sheet feed motor 5, the printing head driving motor 12, the switches 15, and the paper end switch 16 through wires 24 to 27, respectively. The section 7 further includes driving circuits (not shown) interposed between the connector 10 and the connectors 20 to 23 for driving the printing head 2 and the motors 5, 12, and an electric supply (not shown) connected to the driving circuits, etc., the driving circuits and the electric supply being mounted on the board 7*a*.

In FIG. 1, reference numeral 105 denotes a flexible cord for connecting the cassette type control circuit section 8 with the host computer 102. One half portion or female portion 105*a* of the connector is fixedly connected to an end of the cord 105 at the side of the printer 101, whereas the other half portion or male portion 8*a* of the same connector, which is adapted to be disconnectably connected to the female connector portion 105*a*, is secured to an outer end portion of the circuit section 8.

Figure 6:
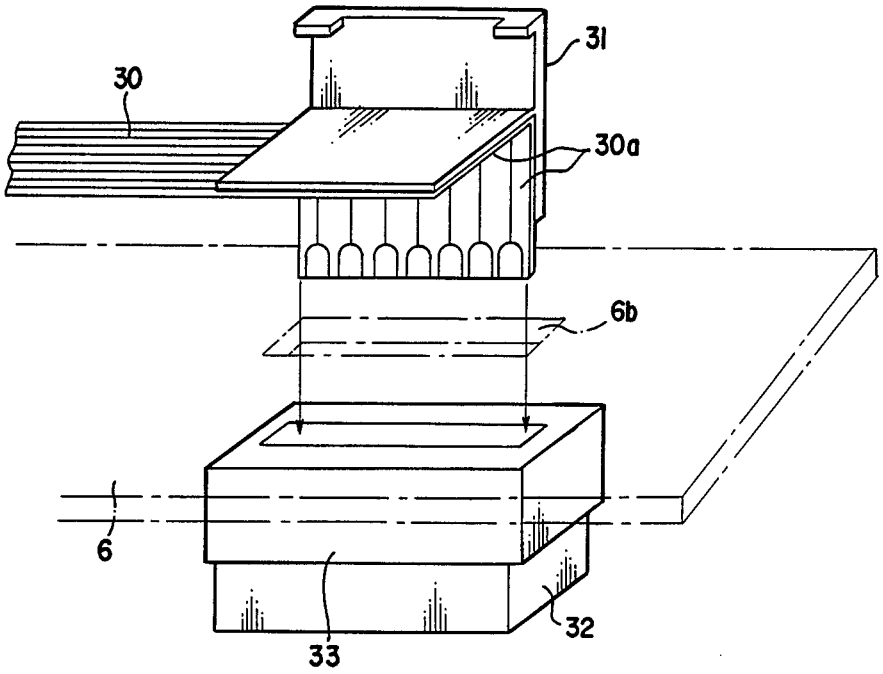
FIG. 6 is an enlarged fragmentary perspective view showing a connection between a control circuit device and a flat cable of FIG. 2.

In FIGS. 2 and 6, reference numeral 30 denotes a flat cable for electrically connecting the printing head 2 with the auxiliary circuit section 7, the cable 30 extending from the head 2 in a horizontal direction and being bent at right angles at an end portion or a bent portion 30*a* on the control circuit section side and then extending in a vertical direction toward the circuit section 7. The first frame 6 is formed with an aperture 6*b* in alignment with a cable fixture 31 to which the bent portion 30*a* of the cable 30 is fastened, and a connector 32 fixed to an upper portion of the auxiliary circuit section 7 and electrically connected thereto, and a cable guide 33 fixed to this connector are disposed in alignment with aperture 6*b*, so that one end of the cable 30 on the auxiliary circuit section side is inserted through the aperture 6*b* and connected to the connector 32 and hence to the auxiliary circuit section 7.

The operation of the printer 101 with the above-mentioned arrangement will be now explained.

Assuming that the cassette type control circuit section 8 has been set in position in the receiving section 104 of the printer 101. First, a user connects the connector portion 105*a* of the cord 105 which is connected to the host computer 102, with the connector portion 8a of the control circuit section 8. This connecting operation can be easily carried out at the lateral side of the printer as compared with that in a conventional printer of the type wherein such operation should be performed at the remote rear side of the printer.

Next, upon actuation of the printer 101 and the external controller 102, control signals are supplied from the external controller 102 to the cassette type control circuit section 8 in which information processing is carried out in a known manner, and a resultant output is supplied therefrom to the printing head 2 and the motors 5, 12 through the connectors 21, 22, 33 of the auxiliary circuit section 7 connected to the former section 8 via the connector 10, so as to operate these elements 2, 5 and 12 to effect printing onto the sheet 106. At that time, the cord 105 connected to the lateral side of the printer 101 never interferes with the sheet 106 which is fed along the rear side of the printer.

When the user wishes to remove the cassette type control circuit section 8 from the printer for maintenance thereof or for change of character pattern and/or interface, after removing the cord 105 from the section 8, he grips the outer wall of the control circuit section 8 to pull same outward, so that the connector portion 10*b* on the control circuit section side is disconnected from the associated stationary connector portion 10*a*. As a result, the whole arrangement of the control circuit section 8 is fully slidably pulled out from the receiving section 104 of the printer through the insert port 104*a* thereof, with the help of the rail-slot mechanism formed in the sections 8, 104. Thereafter, upon insertion of the control circuit section 8 inspected or repaired, or a new circuit section 8 having different character pattern and interface, the thus inserted control circuit section 8 is placed in position in the receiving section 104, with the connector portions 10*a*, 10*b* connected to each other, and the lower end 8*c* of the outer end face 8*b* of the same section 8 abutted to the associated outer side edge of the bottom wall of the printer 101. As a result, the outer end face 8*b* of the section 8 is positioned in flush with the outer end face 101*a* of the printer to form a continuous exterior to provide the printer with a qualified external appearance. The mounting/dismounting of the cassette type control circuit section 8 can be easily carried out without interference with the printing sheet 106.

The present invention provides various advantages as shown below:

(i) Since the cord means for connecting the cassette type control circuit section with the external controller is connected to the side of the printer different from the side along which the printer sheet is supplied, the sheet and the cord means never interfere with each other, to permit the sheet to be fed to the printer smoothly.

(ii) Since the control part of the control circuit device which determines the types of character pattern and interface is arranged in the form of a cassette, the control part of the device can be maintained, inspected or repaired easily, and the mode in which the printer operates, i.e., the manner of interfacing between the printer and the external controller and the patterns of characters to be printed, for instance, can be easily set and arbitrarily changed. This makes it possible to test the printers performance with a special means such as a control circuit section only for test use prior to forwarding the printer, use of the printer in combination with selective external controllers operable in different interface conditions, and printing with arbitrary characters including various kinds of language.

(iii) Since the operating sections of the printer including a printing and sheet feeding mechanism and the control circuit device are disposed at different vertical positions in the printer, the printer can be reduced in size as compared with a conventional printer of a type where these elements are disposed at the same vertical level in the printer, and wiring for electrical connection between the device and the operating sections can be simplified and shortened, resulting in reductions in number of component parts of the printer and an amount of work for assemblage of the printer. For instance, the flat cable and the home position switch can be connected directly to the printed circuit board and thus wiring for these parts can be omitted. Further, shortened wiring makes it possible to reduce noise in operation of the printer.

(iv) Since the cassette type control circuit section is arranged so that, when the same section is mounted in position in the printer, the outer end face thereof cooperates with the associated side face of the printer to form a continuous plane or exterior, the printer is improved in external appearance.

What is claimed is:

1. A printer with operating sections including a printing mechanism and a sheet feeding mechanism, and a control circuit device adapted to be connected to an external controller through cord means for drivingly controlling said operating sections, comprising:

said control circuit device including a control circuit section arranged in the form of a cassette and having an outer end portion thereof on which one half portion of a connector means is mounted, the one half portion of the connector means being adapted to be connected to an other half portion of the connector means which is connected to an associated end of said cord means; and a receiving section defined in an internal space of said printer for accommodating therein said control circuit section, said receiving section having an insert port which opens into a first side of said printer different from a second side of said printer along which a printing sheet is fed to said sheet feeding mechanism, said control circuit section being detachably mounted in said receiving section through said insert port.

2. A printer according to claim 1, wherein said first side of said printer is one lateral side of said printer, said second side of said printer being a rear side of said printer.

3. A printer according to claim 2, wherein said control circuit section has an outer end face which cooperates with the one lateral side of said printer to form a continuous exterior when said control circuit section is mounted in said receiving section.

4. A printer according to claim 1, wherein said operating sections and said control circuit device are disposed at different vertical locations from each other in the internal space of said printer.

5. A printer according to claim 4, wherein said control circuit device is disposed at a location below said operating sections.

6. A printer according to claim 4, further including:

first frame means and second frame means disposed in the internal space of said printer in a manner separated from each other in a vertical direction of said printer, wherein said control circuit device comprises said control circuit section, an auxiliary circuit section, and connector means disposed in alignment with said control circuit section and said auxiliary circuit section in a direction vertically of said printer for electrically connecting said both of circuit sections with each other, at least part of said operating sections being secured to said first frame means, said auxiliary circuit section being secured to said second frame means.

7. A printer according to claim 6, wherein said auxiliary circuit section comprises a printed circuit board secured to said second frame means, driving circuits for driving said operating sections, an electric supply and a group of connectors electrically connected to associated portions of said operating sections, said driving circuits, said electric supply and said connectors being secured to said printed circuit board.

8. A printer according to claim 1, wherein said control circuit section includes an information processing device for receiving the control signals supplied from said external controller to effect information processing.

9. A printer according to claim 8, wherein said information processing device includes a central processor unit, a memory device connected to said central processor unit for generating character patterns, and input/output ports interposed between said central processor unit and said external controller and between said central processor unit and said operating sections.

* * * * *